United States Patent [19]

Yan

[11] 4,118,201

[45] Oct. 3, 1978

[54] PRODUCTION OF LOW SULFUR FUELS FROM COAL

[75] Inventor: Tsoung-Yuan Yan, Philadelphia, Pa.

[73] Assignee: Mobil Oil Corporation, New York, N.Y.

[21] Appl. No.: 813,914

[22] Filed: Jul. 8, 1977

Related U.S. Application Data

[63] Continuation-in-part of Ser. No. 705,198, Jul. 14, 1976, abandoned.

[51] Int. Cl.[2] ..... C10L 9/10; C10G 1/00; C10B 57/00

[52] U.S. Cl. ..... 44/1 R; 48/197 R; 48/202; 201/17; 208/8

[58] Field of Search ..... 44/1 R; 208/8; 201/17; 48/197 R, 202, 206

[56] References Cited

U.S. PATENT DOCUMENTS

| | | | |
|---|---|---|---|
| 3,817,723 | 6/1974 | Donath | 48/197 R |
| 3,909,212 | 9/1975 | Schroeder | 44/1 R |
| 3,912,465 | 10/1975 | Kunii et al. | 48/202 X |
| 3,945,809 | 3/1976 | Donath | 48/202 X |
| 3,954,596 | 5/1976 | Schroeder | 208/8 X |

*Primary Examiner*—Carl Dees

*Attorney, Agent, or Firm*—Charles A. Huggett; Carl D. Farnsworth

[57] ABSTRACT

A general method for producing low-sulfur gas and solid fuel is disclosed. Such method involves partial gasification of coal, using steam and an oxygen-containing gas, to produce low-B.t.u. fuel which can be used as a feedstock for power plants and industrial boilers. Also disclosed is a method for simultaneously producing low-sulfur gas, liquid, and solid fuels from coal in a single reaction vessel using a multi-stage fluidized gasification and desulfurization system. Synthesis gas produced in a first stage gas generator by reaction of steam, an oxygen-containing gas, and auxiliary carbonaceous fuel, is reacted with high-sulfur coal in a second stage desulfurization unit forming a solid phase consisting of low-sulfur fuel and a fluid phase consisting of sulfur-containing gaseous and liquid fuels. After disengagement of solid and fluid phases present in the second stage reaction zone, a solid fuel of reduced sulfur content is recovered.

5 Claims, 2 Drawing Figures

PRODUCTION OF LOW SULFUR FUELS FROM COAL

RELATED APPLICATIONS

This application is a continuation-in-part of Ser. No. 705,198 filed July 14, 1976 and now abandoned.

BACKGROUND OF THE INVENTION

This invention relates to an improved process for reducing sulfur content of solid carbonaceous fuels, such as coal and lignite, to provide gas, liquid, and solid fuel products which can be burned without further treatment or use of special devices to produce stack gases which meet pollution regulations regarding sulfur emissions. More particularly, it relates to the removal of pyritic and organic sulfur from coal without added hydrogen.

Coal constitutes the largest single fossil fuel source of the United States. Nevertheless, its use has been restricted because of environmental regulations and the availability of petroleum and natural gas as alternative sources of energy. However, to achieve the national goal of energy self-sufficiency it is now apparent that coal must play a major role in meeting our expanding energy requirements. A principal drawback to the use of United States coal is the sulfur content, which can range up to 5 percent or more; large quantities of sulfur compounds, which have been found to be environmentally hazardous, are discharged into the atmosphere when coal is burned to produce energy.

A variety of methods have been suggested to reduce the discharge of such sulfur compounds into the atmosphere when sulfur-containing fuels such as coal are burned. Two general methods have been tried. One method involves removing sulfur from stack gases after the sulfur-containing fuel is burned, whereas the other method removes sulfur from the fuel before it is burned. While numerous methods have been tried for stack gas cleaning, none appear to be simple or low cost. The inherent difficulties of such an approach are the enormous volumes of stack gas that must be processed and the low concentration of sulfur in these gases.

It is desirable to reduce the sulfur content of the coal initially. If this is successful, then the fuel can be burned as it has been in the past — i.e. without material change in the operation of furnaces, boilers, and utility plants. Moreover, sulfur removal may be accomplished at one location without the need to provide extensive sulfur removal facilities at each location. Accordingly, it is very desirable to be able to substantially reduce the sulfur content of a coal before it is burned as a fuel or otherwise gasified and/or liquified for further processing into specific fuels.

The solvent-refined coal or coal extraction process reduces the sulfur content of coal by first dissolving the coal in a suitable solvent to produce a mixture of liquid and undissolved solids from which the solid may be removed by filtration or other conventional solids — liquid separation processes. The dissolution step is often carried out under hydrogen pressure. Solvent is recovered from the filtrate by means such as vacuum distillation. The distillation residue can be handled in either solid or liquid form and is a low ash, low sulfur material known as solvent refined coal or coal extract. However, such a process has relatively expensive and complex equipment requirements. Furthermore, considerable difficulty has been encountered in the solvent-extract-/undissolved residue separation step. Finally, although such a process converts a majority of the coal feed to a low-sulfur fuel product, the process is inefficient in terms of the quantity of incoming hydrocarbonaceous material converted. For example, extract yields normally approach 80 percent of the moisture and ash-free coal feed.

A variation of the solvent refined coal process is the coal liquefaction process which is characterized by the attempt to completely hydrogenate or liquify coal to produce an oil-like product very low in sulfur. The process is subject to the same disadvantages as the solvent refined coal process, referred to above; and, in addition, the operating costs of the process are exceptionally high because of the large hydrogen requirements.

The use of fluidized systems wherein a fluidized stream of finely divided coal particles and/or heated char particles is formed in a carrier stream to pyrolyze the coal particles, extracting the volatiles therefrom, is well known in the art. The heated char particles and/or the carrier gas stream are utilized to provide the requisite heat of pyrolysis to the coal particles. A supply of heated char is continuously produced upon pyrolysis of the coal in the system. Sulfur contaminants may be removed by the addition of sulfur acceptors such as iron oxides or lime to the particulate coal prior to processing or by heating the products to high temperatures in the presence of hydrogen upon removal of the products from the pyrolysis zone. Alternatively, desulfurization may be achieved during pyrolysis by enriching the carrier gas stream with hydrogen, which may be generated within the process by known gasification methods. Exemplary of such systems are: U.S. Pat. Nos. 3,007,849; 3,702,516; 3,736,233. Additional references relating to the pyrolysis method which are considered of some pertinency are found in *Coal Processing Technology*, Vol. 2, *American Institute of Chemical Engineers*, New York, N.Y. (1975), pp. 83–93, 119–120.

Another method employed to reduce the sulfur content of high-sulfur coal is the gasification of coal with steam and air or oxygen to produce fuel gas which must then be desulfurized prior to combustion. For example, U.S. Pat. No. 2,634,286, teaches hydrogenation of coal in the dry state by passing a stream of heated, hydrogen-containing gas upwardly through a reaction zone containing a mass of the substantially dry coal particles at a velocity sufficient to fluidize the mass. The reaction zone is maintained under an elevated temperature (450° to 650° C.) and pressure (250 to 1500 psi). The hydrogen and the coal react to produce a major proportion of liquid hydrocarbons and a minor proportion of gaseous hydrocarbons together with a finely-divided, solid, low-sulfur content char. Processes similar to U.S. Pat. No. 2,634,286 are also discussed in *Coal Processing Technology*, Vol. 2, *American Institute of Chemical Engineers*, New York, N.Y. (1975), pp. 88–93 and 119–120.

The present invention differs from the gasification process referred to above in that the production of gaseous fuels is not maximized. Rather, only a minimum amount of coal is gasified and converted to liquid and gas products.

U.S. Pat. No. 3,909,212 issued to Schroeder discloses the concept of producing a low-sulfur solid fuel from coal with minimum chemical change in the coal without added hydrogen. The primary fuel product is not a coke or char; the feed coal is carbonized only to the extent necessary to remove a substantial amount of the sulfur from the coal. The desulfurized coal still contains sufficient volatile matter to be a satisfactory fuel for combustion purposes. The process comprises reacting particulate coal under a pressure of at least two atmospheres with an oxygen-containing gas and steam in a reaction zone. The amount of oxygen-containing gas is just sufficient to burn that portion of the particulate coal which will raise the temperature of the coal in the reaction zone to about 1100° to 1500° F. The amount of steam is sufficient to react with the fuel particles to generate nascent hydrogen which reacts with the sulfur in the fuel particles to form hydrogen sulfide. In a preferred embodiment of the invention, the amount of hydrogen, including that generated by the steam reaction and that present in the coal, is about 4 to 5 times that theoretically required for reaction with all of the sulfur in the coal to produce $H_2S$.

SUMMARY OF THE INVENTION

The present invention is an improved method of desulfurizing coal to produce a maximum amount of solid, low-sulfur carbonaceous fuel which is satisfactory and economical for combustion purposes as well as for gasification to produce low-sulfur fuel gases or for the manufacture of industrial chemicals. It is superior to those processes which attempt to completely gasify or liquify the raw coal because of reduced equipment and facility requirements. Furthermore, the volume of fluid overhead products which must be purified to remove $H_2S$ and other sulfur contaminants is reduced, thereby reducing costs involved in that purification step. Moreover, this invention is practiced without the necessity of added hydrogen — all of the hydrogen or other reducing gases necessary for the desulfurization of the coal being generated within the process.

In its broadest aspect, the invention resides in the partial gasification of coal in a fluidized bed gasifier wherein finely divided coal is fed to a gasifier along with steam plus air or oxygen. Partial gasification is effected to produce an overhead product comprising a low sulfur partially gasified char entrained in a product gas containing mainly hydrogen and carbon monoxide. The char is separated, mixed with air and then used as a direct supply of fuel for power plants or industrial boilers which utilize low B.t.u. fuel. The product gas phase is recovered and may be purified by conventional procedures.

In another embodiment of the invention, an auxiliary fuel, such as finely divided or pulverized coal is fed to a first stage fluidized reaction zone where it is reacted with air or oxygen and steam to produce a synthesis gas composed primarily of hydrogen and carbon monoxide. The gasification unit is operated as the first stage of a two-stage fluidized reaction system and the reducing gases generated therein are passed outwardly at velocities sufficient to fluidize fresh coal continuously introduced into a second stage desulfurization zone operated in immediate conjunction therewith. In the desulfurization zone, hydrogen, and CO react with pyritic and organic sulfur contained in the coal to form hydrogen sulfide and small amounts of carbonyl sulfide. The effluent stream from the desulfurization zone is separated from the treated coal by conventional gas-solids separation techniques, e.g., a cyclone separator, and the desulfurized coal product is collected and removed for ultimate use as a fuel for power plants or for use as fuel in the first stage pyrolysis portion of the system. The gas stream is recovered by suitable condensation means and the liquid products and non-condensable gases are sent to purification operations for removal of undesirable products such as water, hydrogen sulfide, and carbon dioxide. While the production of synthesis gas and desulfurization of coal with hydrogen or other reducing gases are well-known processes, the specific feature with which this invention is particularly concerned is the pyrolysis and desulfurization of coal in a single reaction vessel employing a two-stage fluidized reaction system, the first stage of which pyrolizes coal to generate synthesis gas which is then used to fluidize and desulfurize coal introduced into the second stage operation. The heat generated in the pyrolysis step is used in maintaining the desulfurization reaction at the chosen temperature whereby the overall result of treatment with synthesis gas is the production of a low sulfur content coal. By means of this embodiment there is provided a relatively simple and economical process for the production of solid carbonaceous fuels which have a sulfur content of less than about 1 percent.

Accordingly, an object of this invention is to produce a maximum quantity of solid, low-sulfur fuel through minimum chemical changes in coal. A further object of this invention is the production of low-sulfur fuels from coal without added hydrogen. A still further object of this invention is the production of solid, liquid, and gaseous fuels which will comply with applicable sulfur emission standards upon combustion. Another object of this invention is to provide a coal desulfurization process which may be integrated with power plants to provide economical, low-sulfur fuels, part of which may be stored for peak load use.

DESCRIPTION OF PREFERRED EMBODIMENTS

The invention is generally applicable to any type of coal, and within the context of the present invention it will be understood that the term "coal" refers to any naturally-occurring, sulfur-containing, solid, carbonaceous material, such as anthracite coal, bituminous coal, sub-bituminous coal, lignite, peat, and the like. In order to meet the current $SO_2$ emission standard, coals particularly suited to the process of this invention are those containing about 3.5 percent sulfur and lower, especially those containing large amounts of pyritic sulfur relative to organic sulfur. Since pyritic sulfur removal is substantially complete, in the preferred embodiment coals of higher sulfur content can be used if the relative content of pyrite is high.

The high-sulfur coal treated by the process of this invention is pulverized or crushed to a size less than 3 mesh (U.S. Sieve Series) and is preferably in the range between 40 and 200 mesh. Drying of the coal is not required. While it is recognized that the moisture present in the coal requires heat energy to vaporize the water to raise the coal temperature to the high temperature required by the process, such heat requirements does not diminish the process.

Figure 1:
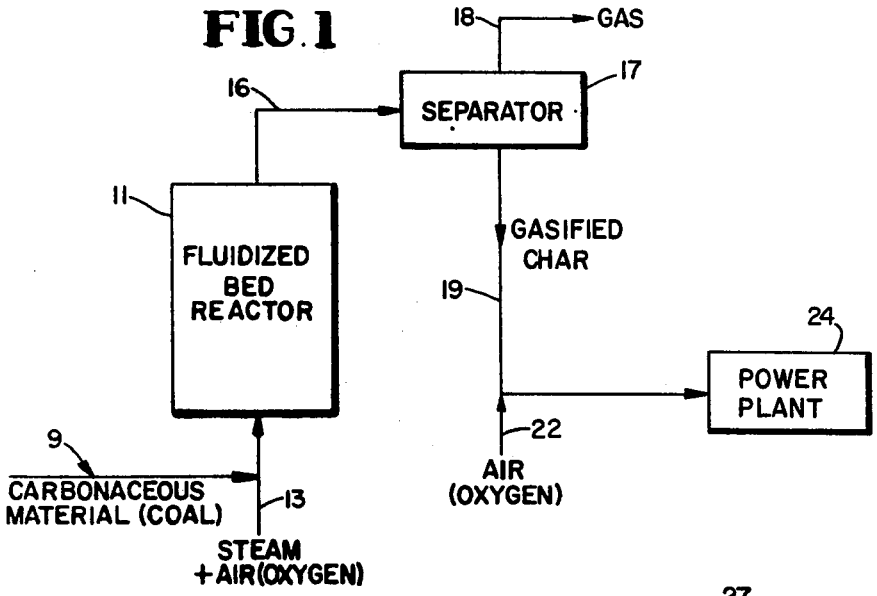
FIG. 1 is a flow sheet diagram of an embodiment of the invention utilizing a single stage fluidized bed gasifier.

With reference to FIG. 1, partial gasification utilizing a fluid bed system is shown. Coal reduced to a particle size of preferably about 200 mesh in a pulverizer (not shown) is preheated to a temperature of about 800° F. and continuously introduced by conduit 9 to reactor 11. Steam and air (or oxygen) is fed to the reactor via conduit 13 to maintain the solids in a fluidized condition at a temperature of about 900° F. to 1500° F., preferably about 900° F. to 1000° F. The temperature is maintained by using superheated steam although heat also can be provided by the addition of oxygen.

The pressure may vary widely up to 500 psi but pressures under 200 psi are preferred. Lower pressures are particularly preferred since reduced conversions are obtained. In a typical fluidized gasifier having a diameter (I.D.) of 18 feet, 0.5 to 2.5 pounds of air or oxygen is used per pound of coal. The amount of steam introduced will generally be in the range of 0.1 to 0.3 pounds per pound of coal. The steam temperature is conveniently between 800° F. and 1200° F. and the pressure is substantially atmospheric. At pressures of 15 to 30 p.s.i. conventional petroleum processing equipment can be utilized.

In the gasification reactor 11, steam and carbon are converted to carbon monoxide and hydrogen by the water gas reaction. Carbon dioxide and methane also appear in the product gases. At the temperatures and pressures prescribed, partial gasification, i.e., 5 to 30%, of the feed coal is achieved. Residence time of the reactants should be less than 60 minutes, and preferably less than 20 minutes. The product of the reaction is a low sulfur partially gasified char entrained in the product gas which is withdrawn from the upper portion of reactor 11 and sent through conduit 16 into separator 17.

The product gas withdrawn from separator 17 is sent through conduit 18 to a product gas purification unit (not shown). This stream contains primarily CO and $H_2$ with varying amounts of water, carbon dioxide and light hydrocarbons. The gas product may be refined or purified by conventional procedures of separation, conversion, treating, etc., to provide a low sulfur, low B.t.u. gas. The gas product may be condensed, for example, to form a gas phase, hydrocarbon phase and an aqueous phase. The gas phase may be treated for removal of $CO_2$ and $H_2S$ and may be recycled.

The partially gasified char is separated from product gases in separator 17 at a temperature of about 900° F. and sent through conduit 19 where it is mixed with air or oxygen via conduit 22 and used as a low B.t.u. fuel supply for power plants employing boilers or furnaces 24; e.g., industrial complexes which produce primary metals, chemicals, and stone/glass/clay products.

In this embodiment, it can be seen that small to medium gasifiers can be directly used on site for industrial applications. The low sulfur fuel produced from partially gasified char has the advantage of ready availability and can be stored for peak load use. Moreover, because of the need for uninterrupted supplies of fuel, an industrial plant can be built around or near the coal gasification unit. In view of the national fuel supply situation, partial gasification can be employed to assure a continuous supply of acceptable fuel.

Figure 2:
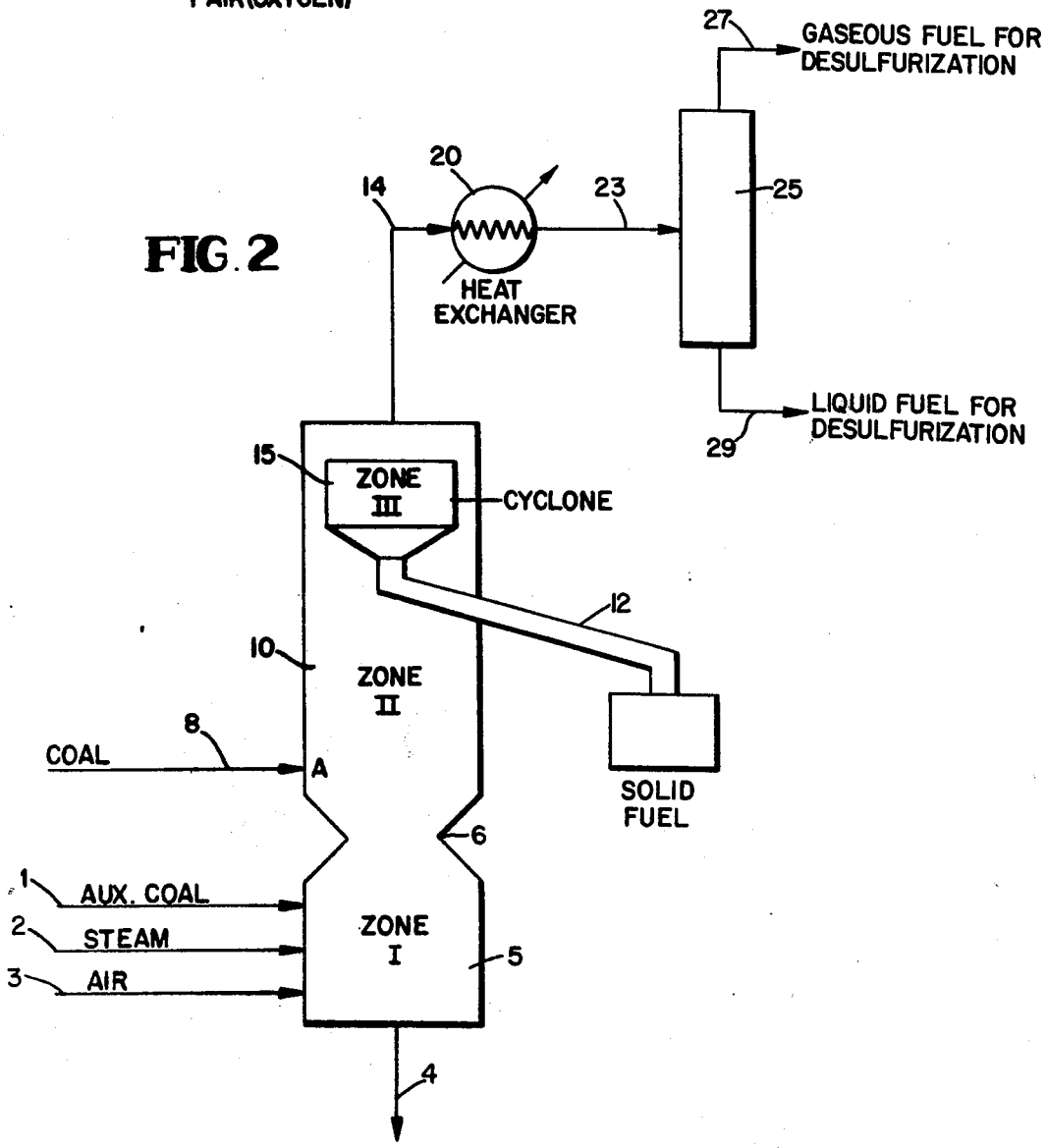
FIG. 2 is a flow sheet diagram of another embodiment of the invention using a multi-stage fluidized gasification and desulfurization system.

Referring now to FIG. 2 of the drawing, auxiliary coal fuel, steam and air are fed to the bottom of zone 5 through lines 1, 2 and 3 respectively, and cause the fuel bed to be fluidized. The steam and air react with the coal and generate synthesis gas which passes upwardly through orifice 6. Synthesis gas, a mixture of carbon monoxide and hydrogen, is commonly made by the partial oxidation of a carbonaceous feed by means of a gaseous oxidant such as 95 mole percent oxygen or oxygen-enriched air. The raw synthesis gas thus made comprises principally CO and $H_2$, together with varying amounts of $H_2O$, $CO_2$, $CH_4$ and $H_2S$.

When the oxidant contains air, the product gas may be diluted with about 30–45 mole percent nitrogen. In the process of this invention, steam, an oxygen-containing gas, and an auxiliary carbonaceous fuel are contacted in the synthesis gas generating zone to produce a synthesis gas having a maximum content of hydrogen gas. The temperature of the synthesis gas generating zone is maintained at about 1800° to 3000° F. and is controlled by preheating the inlet oxygen-containing gas, preheating the inlet steam, varying the quantity of inlet auxiliary carbonaceous fuel and/or varying the steam/oxygen containing gas ratio according to well-known relationships. In the synthesis gas generating zone the following reactions take place:

(1) $(n+1)C + (0.5 + n)O_2 \rightarrow CO + (n)CO_2$
(2) $2CO + O_2 \rightarrow 2CO_2$
(3) $CO_2 + C \rightleftarrows 2CO$
(4) $H_2O + C \rightleftarrows H_2 + CO$
(5) $H_2O + CO \rightleftarrows CO_2 + H_2$ The synthesis gas is generated by the fluid solids technique. By "fluidized" is meant a condition in which the granular or powdered fuel and ash is suspended by steam or air to form a suspension moving generally upward and at the same time permitting delayed settling of the ash which results from combustion. The depth of the fluidized bed may be on the order of 5 feet and gas velocity up through the bed about 1 foot per second. Air and steam rates are adjusted so that the temperature in the generation zone is maintained at about 100° F. higher than the ash fusion temperature of the auxiliary fuel introduced via line 1. If necessary, fluxes can be added to the coal to adjust the fusion temperature. At a temperature of 2000° F. and 300 psig. a synthesis gas is produced having a typical analysis of 20–30 percent hydrogen, 10–20 percent $CO_2$, 15–20 percent CO, 1–50 percent of light hydrocarbons (mainly methane), and 30–45 percent $N_2$. Ash produced in the process which is free of unburnt carbon is removed in molten form through line 4 as slag.

The through-put of the auxiliary coal in zone 5 is dependent on the temperature and generally ranges from 50 to 1000 lb./hr./cu. ft. The amount of steam used will normally be in the range of 40 to 70 weight percent based on the auxiliary coal or fuel employed. Pressures of 100 to 1000 psig. are advantageously employed. Suitable processes for air-steam gasification are disclosed in *Industrial and Engineering Chemistry,* Vol. 40, pp. 559–82 and *Coal Processing Technology,* Vol. 2, pp. 145–147.

Heated synthesis gas passes upward from the synthesis gas generating zone through orifice 6 to fluidized reaction zone 10 wherein the upwardly moving synthesis gas fluidizes an incoming stream of pulverized coal fed to reaction zone 10 through line 8. Since the heat supplied to zone 10 is derived from the synthesis gas, the temperature will depend on the temperature in zone 5. Ordinarily, the temperature of zone 10 will be in the range of 1100° F. to 1700° F., preferably about 1500° F., to ensure effective desulfurization of the coal.

The pressure in zone 10 should be maintained within the range from about 100 to 1000 psig. Higher pressure is preferred to completely remove sulfur from the solid fuel product and to obtain gaseous fuel at higher pressure and higher throughput. However, high operating pressures result in greater equipment and operational costs.

The ultimate desulfurization which can be achieved at any temperature is limited by thermodynamic equilibrium and depends on the ratio of $H_2S:H_2$ in the treating gas at the exit of the reactor with little regard to the temperature and absolute pressure of the reaction system. While greater absolute pressure increases the rate of desulfurization, it does not affect the ultimate level of sulfur in the treated solids; higher pressure accomplishes the same ultimate desulfurization as atmospheric pressure, but does so in less time.

Since the ultimate desulfurization of high-sulfur coal depends on the ratio of $H_2S:H_2$ in the synthesis gas passing from the synthesis gas generating zone 5 to the desulfurization zone 10, it may appear desirable to employ a low-sulfur, auxiliary carbonaceous fuel in the synthesis gas generating zone to minimize the $H_2S$ content of the synthesis gas. An example of such fuel is the low-sulfur solid fuel product of this invention. However, in the preferred embodiment of this invention, the auxiliary carbonaceous fuel is untreated coal. Use of untreated coal in the synthesis gas generating zone has obvious economic advantages and will produce a synthesis gas which will effectively reduce the sulfur content of the coal fed to the fluidized reaction zone so long as the $H_2S$ to $H_2$ ratio in the synthesis gas is well below the equilibrium value of $H_2S$ at the operating temperature of the fluidized reaction zone.

The incoming stream of pulverized coal fed through line 8 is contacted with heated synthesis gas in zone 10 for a time sufficient to lower the sulfur content of the pulverized coal while effecting minimum chemical changes in the coal. Trace amounts of excess oxygen present in the synthesis gas react with the pyrite containing coal to form $SO_2$. Additionally, the excessive thermal conditions and high pressure hydrogen gas convert substantial amounts of organic sulfur and nearly all of the pyritic sulfur to hydrogen sulfide. Pyrolysis and devolatilization, as well as drying, also take place in zone 10. In zone 10, the aim is to produce a low-sulfur, solid fuel, as opposed to gasifying the pulverized coal. Depending on the sulfur content and reactivity of the pulverized coal, the operating pressure and temperature of zone 10, and the ratio of $H_2S$ to $H_2$ in the synthesis gas passing through opening 6; the residence time in zone 10 will vary from about 10 seconds to 100 minutes. It is to be understood that the residence time will vary depending upon the desired relative yield of gas, liquid and solid.

The low-sulfur solid and sulfur-containing fluid phases are disengaged in zone 10 by cyclone 15. Although the cyclone 15 is within zone 10 in a preferred embodiment, it will be understood that the cyclone also may be external to the fluidized reaction. Furthermore, although the disengaging means in the preferred embodiment is an internally-disposed cyclone, it is understood that other conventional separation means known in the art may be used. The solid fuel has a reduced sulfur content of less than about 1 percent and is recovered from zone 10 through line 12 for storage or for immediate combustion as fuel. The recovered low-sulfur material may also be employed in a subsequent gasification or liquefaction process.

The sulfur-containing fluid phase disengaged by cyclone 15 is passed from zone 10 through line 14 to heat exchanger 20 to recover heat energy for return to the process or for other appropriate purposes. For example, the heat exchanger 20 may serve as a preheater for the steam or air (or other oxygen-containing gas) prior to their introduction into zone 5.

The cooled sulfur-containing fluid passes from the heat exchanger 20 through line 23 to condenser 25 to recover a sulfur-containing non-condensable gaseous fuel through line 27 and a sulfur-containing liquid fuel through line 29. These products may then be purified by conventional desulfurizing and deashing methods. The gaseous product of the purification step (not shown in the drawing) is substantially a sulfur-free low intermediate BTU gaseous fuel; the liquid product of the purification step is a substantially sulfur-free liquid fuel resembling a fuel oil of good quality.

What is claimed is:

1. A process for desulfurizing sulfur-containing solid carbonaceous fuel in the form of pulverized coal in a multi-stage fluidized reaction system comprising a gas generating zone, a desulfurization zone and a gas-solids separating zone, the generating and desulfurization zones having operating conditions dependent upon one another, to produce a maximum amount of solid, low-sulfur carbonaceous fuel which is useful as a direct supply of fuel for power plants or industrial boilers which utilize low B.T.U. fuel comprising the steps:

(a) reacting an oxygen-containing gas, steam, and auxiliary carbonaceous fuel in a fluidized state at a temperature of 1800° to 3000° F. in a gas generating zone to form synthesis gas comprising hydrogen and carbon monoxide;

(b) continuously passing heated synthesis gas upwardly into a desulfurization zone and introducing into said zone fresh pulverized coal solids;

(c) maintaining the coal solids in said zone in a fluidized state at a temperature in the range of 1100° F. to 1700° F. under a pressure of about 100 to 1000 psig for a period of time sufficient to form hydrogen sulfide and thereby reduce the sulfur content of the coal to below about 1 percent by weight, and (d) disengaging sulfur-containing gases from the desulfurization zone and recovering a solid fuel product of reduced sulfur content.

2. The process of claim 1 wherein the residence time of the solids in the desulfurization zone is from 10 seconds to 100 minutes.

3. The process of claim 1 wherein the auxiliary carbonaceous fuel is coal.

4. The process of claim 3 wherein the temperature in the synthesis gas generating zone is about 100° F. higher than the ash fusion temperature of the auxiliary coal fuel and molten ash is discharged from the synthesis gas generating zone as slag.

5. The process of claim 4 wherein the fluid phase disengaged from the solid and fluid phases present in the fluidized reaction zone is cooled to recover heat and to separate sulfur-containing gaseous and liquid fuels which fuels are purified to produce a substantially sulfur-free liquid fuel.

* * * * *